US007001159B2

(12) United States Patent
Peterson, Jr. et al.

(10) Patent No.: US 7,001,159 B2
(45) Date of Patent: Feb. 21, 2006

(54) MOTOR-DRIVEN PUMP FOR POOL OR SPA

(75) Inventors: David J. Peterson, Jr., San Diego, CA (US); Hassan Hamza, Simi Valley, CA (US); Kenneth A. Peterson, Temecula, CA (US); Jeffrey A. Wichmann, Cardiff, CA (US)

(73) Assignee: Polaris Pool Systems, Inc., Vista, CA (US)

( * ) Notice: Subject to any disclaimer, the term of this patent is extended or adjusted under 35 U.S.C. 154(b) by 0 days.

(21) Appl. No.: 11/035,504

(22) Filed: Jan. 13, 2005

(65) Prior Publication Data

US 2005/0158195 A1 Jul. 21, 2005

Related U.S. Application Data

(60) Provisional application No. 60/537,083, filed on Jan. 16, 2004.

(51) Int. Cl.
*F04B 17/03* (2006.01)

(52) U.S. Cl. ..... 417/423.11; 277/427; 277/508; 415/174.3

(58) Field of Classification Search ..... 417/423.11; 277/427, 508; 415/171.1, 174.2, 174.3, 230, 415/231

See application file for complete search history.

(56) References Cited

U.S. PATENT DOCUMENTS 347,197 A * 8/1886 Pohlman ..... 277/508
2,312,525 A * 3/1943 Curtis ..... 417/423.11
2,369,282 A * 2/1945 Curtis et al. ..... 417/423.11
2,842,063 A * 7/1958 Kishline et al. ..... 415/174.3
3,359,911 A * 12/1967 Weinstein ..... 417/423.11
3,549,277 A * 12/1970 Howard et al. ..... 417/321
3,552,888 A * 1/1971 Ericksson ..... 417/423.11
3,822,754 A 7/1974 Henkin et al.
3,850,550 A * 11/1974 Kaessen ..... 417/423.11
3,871,796 A * 3/1975 Mack ..... 417/423.11
3,914,072 A * 10/1975 Rowley et al. ..... 417/423.11
4,172,310 A * 10/1979 Mincuzzi ..... 415/174.3
4,380,416 A * 4/1983 Menager ..... 415/174.3
4,558,479 A 12/1985 Greskovics et al.
4,589,986 A 5/1986 Greskovics et al.
4,955,793 A * 9/1990 Caoduro ..... 417/423.11
5,863,425 A 1/1999 Herlehy et al.
6,422,822 B1 * 7/2002 Holmes ..... 417/423.11

* cited by examiner

*Primary Examiner*—Michael Koczo, Jr.
(74) *Attorney, Agent, or Firm*—Kilpatrick Stockton LLP

(57) ABSTRACT

An improved motor-driven pump is provided for delivering a flow of water in a swimming pool or spa environment or the like. The improved pump includes a motor mounted within a motor housing having a seal plate mounted at one end thereof. The seal plate carries a shaft bearing for rotatably supporting a drive shaft having an outboard end connected to an impeller disposed within a pump chamber defined cooperatively by the seal plate and a volute housing mounted thereon. A primary seal assembly includes an axially spring-loaded dynamic seal ring carried on the drive shaft for rotation therewith and for running engagement with a stationary bushing carried by the seal plate. A secondary seal assembly is positioned axially between the primary seal assembly and motor bearing, and includes at least one slinger disk for radially outwardly slinging any water leaking past the primary seal assembly through a vent chamber.

20 Claims, 3 Drawing Sheets

MOTOR-DRIVEN PUMP FOR POOL OR SPA

This application claims the benefit of copending U.S. Provisional Application 60/537,083, filed Jan. 16, 2004.

BACKGROUND OF THE INVENTION

This invention relates generally to improvements in motor-driven pumps of the type used, for example, for circulating water in a swimming pool or spa environment or the like. More particularly, this invention relates to an improved, relatively simplified and more compact pump of the type having a seal plate mounted at one end of a motor housing and adapted to support multiple seal components to prevent water leakage past the seal plate and into the motor housing.

Motor-driven pumps for use with a swimming pool or spa are generally known in the art, wherein the pump is adapted to deliver a flow of water under pressure to one or more pool equipment items prior to recirculation of the water to the pool or spa. For example, modern swimming pool and/or spa facilities typically include a filtration unit containing an appropriate filter media for collecting and thus removing solid debris such as fine grit and silt, twigs, leaves, insects, and other particulate matter from water circulated therethrough. A motor-driven pump draws water from the pool and/or spa for delivery to and through the filtration unit, and for subsequent return circulation to the pool and/or spa. This pump is typically operated on a regular schedule to maintain the water in a desired state of cleanliness and clarity. The pump may also circulate the water through additional equipment items such as heating and chemical treatment units and the like.

In some installations, the water can be circulated from the filtration unit to and through an hydraulically driven pool cleaner device mounted in the pool or spa and adapted for dislodging and collecting debris and particulate which has settled onto submerged surfaces. Exemplary hydraulically driven pool cleaner devices are shown and described in U.S. Pat. Nos. 5,863,425; 4,558,479; 4,589,986; and 3,822,754. In some pool equipment configurations, a secondary or so-called booster pump is provided for boosting the pressure of water supplied to the pool cleaner device for insuring proper operation thereof.

Such motor-driven pumps for pool and/or spa use commonly comprise an electric-powered motor of suitable size encased within a motor housing mounted at a suitable and relatively dry location near the associated pool or spa, typically alongside the associated filtration unit and other pool equipment items. The electric motor rotatably drives an output drive shaft which protrudes outwardly through a shaft bearing on the motor housing and is connected to an impeller positioned within a pump chamber defining a suction intake coupled to the body of water within the pool and/or spa, and a discharge outlet coupled to the filtration unit and/or other pool equipment items. A shaft seal arrangement is provided for preventing water leakage from the pump chamber, and resultant axial water migration along the drive shaft in a direction toward the motor housing and into potentially damaging contact with the shaft bearing and/or the electric-powered motor contained therein.

In a common shaft seal arrangement, a ventilated or open cylindrical extension bracket is mounted onto the motor housing in surrounding relation to the protruding drive shaft, and supports a pump housing defining the pump chamber at an outboard end of the extension bracket in axially spaced relation to the motor housing. A primary seal component is provided for sealing passage of the rotatable drive shaft through the pump housing into the pump chamber. With this arrangement, in the event of water leakage past the primary seal component and along the drive shaft in a direction toward the motor housing, such water leakage is normally and harmlessly discharged into the open ventilated space of the extension bracket. A slinger element may be provided on the drive shaft for insuring radial discharge of any such leaking water into the ventilated space of the extension bracket, thereby precluding axial water migration into contact with the motor housing, the shaft bearing, or the electric-powered drive motor.

While such seal arrangements in motor-driven pumps have performed generally in a satisfactory manner, the inclusion of the extension bracket inherently results in a motor-driven pump configuration of extended length which may be unsuitable or undesirable for some mounting locations. In addition, the extension bracket inherently requires the impeller on the drive shaft to be cantilevered a significant axial distance from the shaft bearing on the motor housing, wherein this cantilevered distance can adversely contribute to vibration, noise, and increased bearing wear.

Accordingly, there exists a need for further improvements in and to motor-driven pumps of the type used for circulating water in a swimming pool and/or spa and the like, wherein the extension bracket is eliminated to result in an overall motor-driven pump construction of significantly reduced length, and further wherein an effective seal arrangement is provided for safeguarding the shaft bearing and drive motor against contact with any water leaking along the drive shaft. The present invention fulfills these needs and provides further related advantages.

SUMMARY OF THE INVENTION

In accordance with the invention, an improved motor-driven pump is provided for circulating a flow of water in a swimming pool and/or spa environment or the like. The improved motor-driven pump comprises a drive motor contained within a motor housing having a seal plate mounted at one end thereof and carrying a shaft bearing for rotatably supporting an outwardly protruding drive shaft. An outboard end of the drive shaft is connected to an impeller disposed within a pump chamber defined cooperatively by the seal plate and a volute housing mounted thereon. The seal plate further supports multiple seal components for effectively preventing water leakage from the pump chamber and along the drive shaft into contact with the shaft bearing or drive motor.

In the preferred form, the multiple seal components comprise a primary seal assembly including a stationary annular bushing carried by the seal plate in axially outboard spaced relation to the shaft bearing. This bushing defines an annular outboard face for running engagement by a dynamic seal ring carried on the drive shaft for rotation therewith. In the preferred form, the stationary bushing is constructed from a ceramic material, and the dynamic seal ring is constructed from carbon or the like to provide a low friction sealed interface. The dynamic seal ring is carried at an inboard end of a compliant annular base ring mounted on the drive shaft for rotation therewith, at an axial position between the stationary bushing and a central hub on the impeller. This compliant base ring includes a circumferential outer groove defining an axially opposed pair of shoulders, with a spring seated within said groove for axially expanding the base ring to retain the dynamic seal ring in running engagement with the stationary bushing, and to retain an axial outboard end of the base ring against the impeller hub.

The multiple seal components further include a secondary seal assembly positioned axially between the stationary bushing of the primary seal assembly and the shaft bearing, and within a vent chamber defined by the seal plate. In the preferred form, the secondary seal assembly comprises at least one slinger element or disk for radially outwardly slinging any water leaking past the primary seal assembly in an inboard direction toward the shaft bearing. The vent chamber communicates with a drain channel formed in the seal plate, whereby water displaced radially outwardly by the slinger disk is discharged to atmosphere through the vent chamber and drain channel.

Other features and advantages of the invention will become more apparent from the following detailed description taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
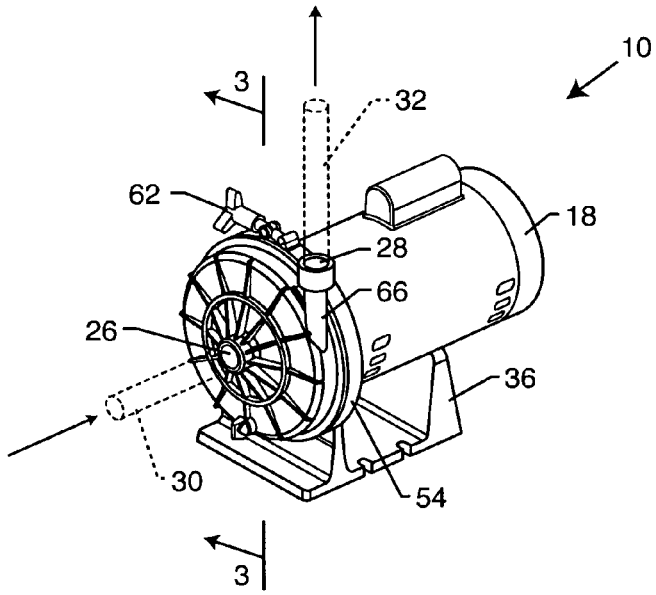
FIG. 1 is a perspective view of a pump for pool or spa use, constructed in accordance with the present invention.
Figure 2:
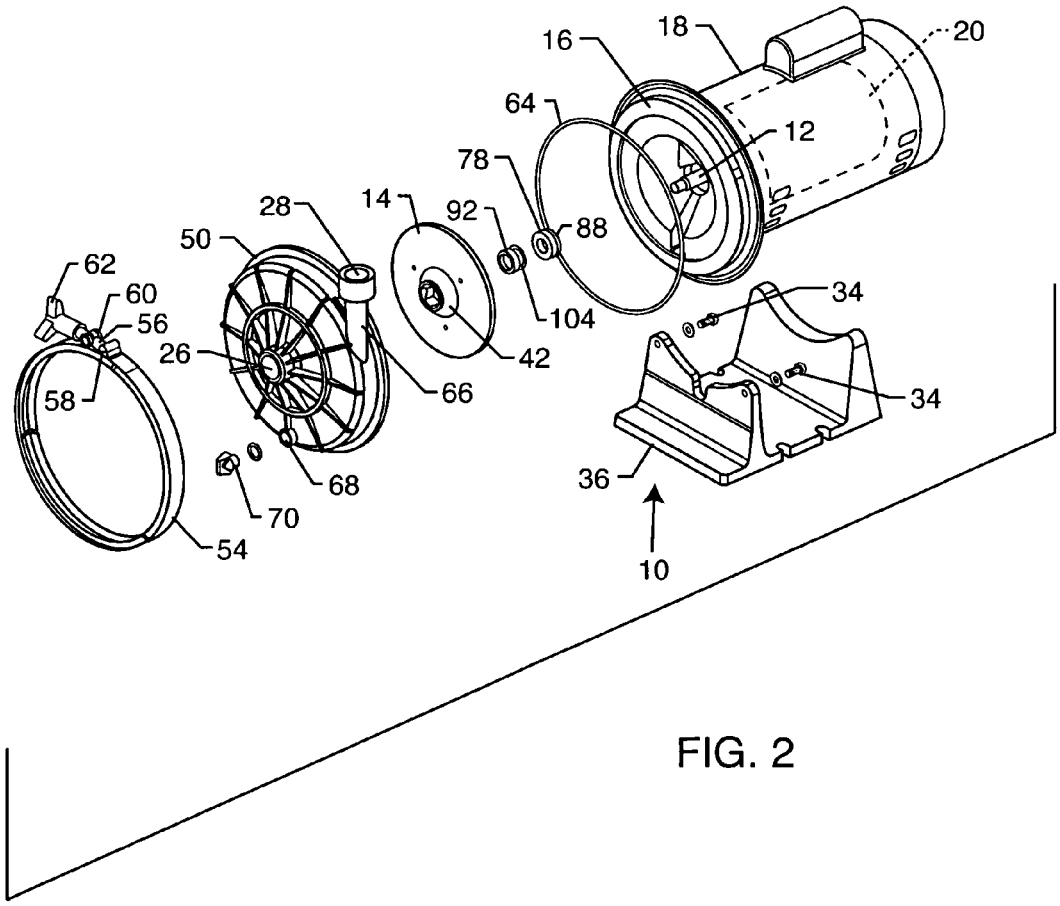
FIG. 2 is an enlarged and exploded perspective view illustrating assembly of components forming the pump of FIG. 1.
Figure 3:
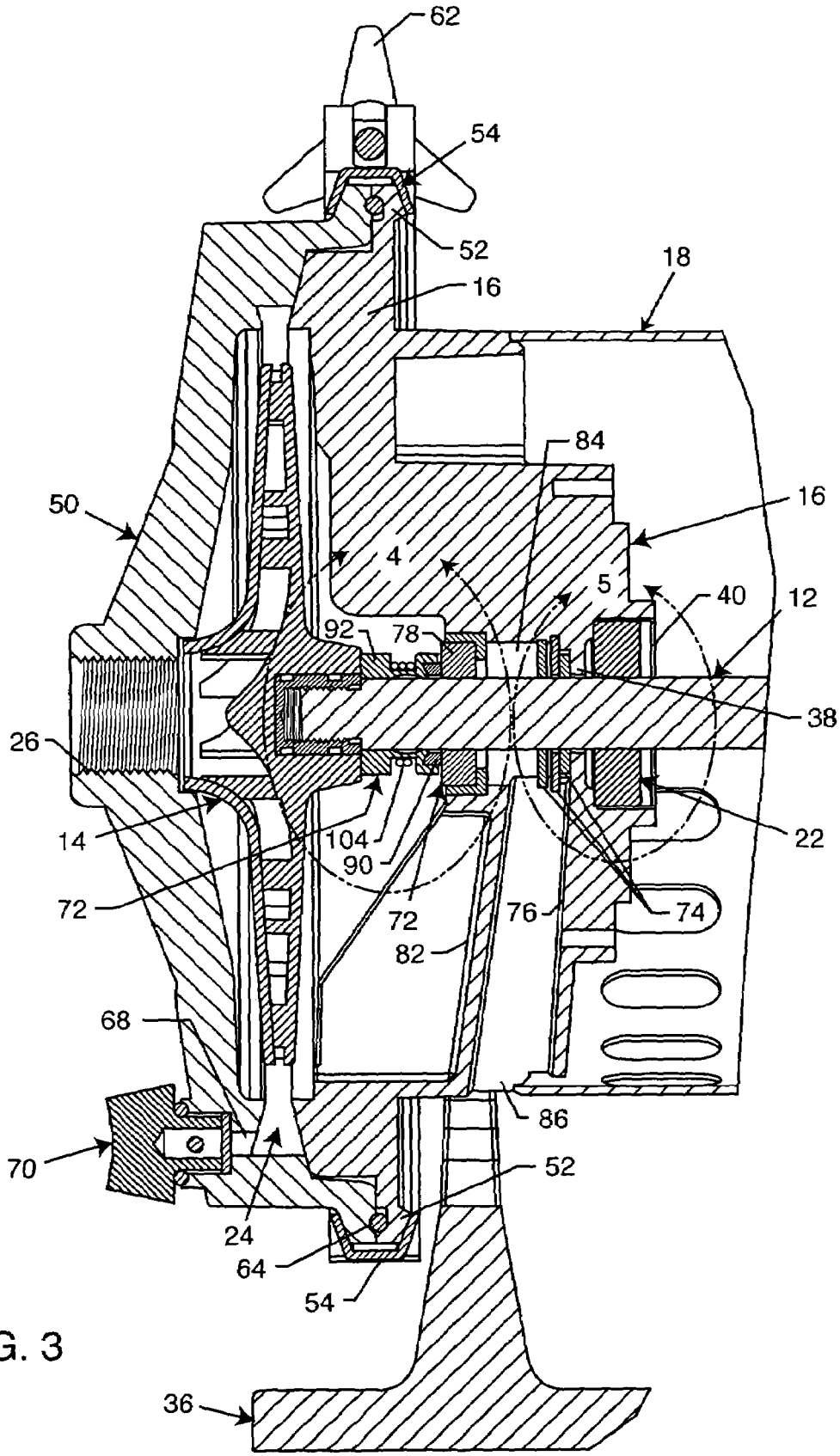
FIG. 3 is an enlarged fragmented sectional view taken generally on the line 3—3 of FIG. 1.

As shown in the exemplary drawings, an improved motor-driven pump referred to generally in FIGS. 1–3 by the reference numeral 10 is provided for circulating a flow of a liquid such as water in a swimming pool or spa environment or the like. The improved pump 10 incorporates a drive shaft 12 (FIGS. 2–4) for rotatably driving an impeller 14 to draw water from the pool and/or spa, and to pump or discharge the water under pressure to one or more items of pool equipment (not shown), such as a water filtration unit, or hydraulically driven pool cleaner device, or the like. In accordance with the invention, the improved pump 10 has a relatively compact and simplified construction to include a seal plate 16 (FIGS. 2–5) at one end of a motor housing 18, wherein this seal plate 16 supports multiple seal components for effectively safeguarding against water leakage into potentially damaging contact with a drive motor 20 (FIG. 2) encased within the motor housing 18, and/or with a shaft bearing 22 (FIGS. 3 and 5) which rotatably supports the drive shaft 12.

In general, the motor-driven pump 10 comprises an electric-powered drive motor 20 of suitable size and power output, for rotatably driving the impeller 14 within a pump chamber 24 (FIGS. 3–4) having a suction intake port 26 and a pressure discharge port 28 (FIGS. 1–2). As illustrated in dotted lines in FIG. 1, the suction intake port 26 may comprise an axial inflow port adapted for connection to a suction conduit 30 which is coupled to the body of water contained within a swimming pool and/or spa (not shown) in a manner known to persons skilled in the art. The pressure discharge port 28 may be tangentially oriented and adapted for connection to a pressure-side discharge conduit 32 which is coupled to one or more pool equipment items (also not shown) such as a water filtration unit, or hydraulically driven pool cleaner device, or the like, again in a manner which is well known to persons skilled in the art. The drive motor 20 is encased within the motor housing 18 having a typically cylindrical shape and adapted for secure and stable mounting by means of bolts 34 (FIG. 2) or the like onto a cradle-shaped stand 36, which is in turn adapted for bolt-down or similar mounting onto a concrete base (not shown) or the like positioned typically at a relatively dry location near or adjacent the associated pool and/or spa, and the associated pool equipment items.

The drive motor 20, when turned on, rotatably drives the drive shaft 12, for rotatably driving the impeller 14 mounted onto one end of the drive shaft. In this regard, the drive shaft 12 protrudes axially outwardly from one end of the motor housing 18, to extend through a central bore 38 (FIGS. 3 and 5) formed in the seal plate 16 which is mounted by bolts (not shown) or the like to extend over and substantially close said one end of the motor housing 18. A shaft bearing 22 is seated within an inboard-side counterbore 40 lining this central bore 38 in the seal plate 16 for rotatably supporting the drive shaft 12.

An outboard end of the drive shaft 12 is suitably configured for rotary drive connection with a central hub 42 of the impeller 14. More particularly, as shown best in FIGS. 3–4, the outboard end of the drive shaft 12 may be formed to define an external thread 44 configured for thread-in connection with an internal thread 46 defined by a cup-shaped insert 48 seated as by co-molding or the like within the central hub 42 of the impeller 14. This insert 48 may be formed from brass or the like, whereas the impeller 14 may be constructed from a sturdy molded plastic or the like. Importantly, the direction of the interengaged threads 44, 46 is selected to prevent loosening of the threaded interface upon rotary driving of the impeller to pump water.

The impeller 14 is rotatably driven within the pump chamber 24, and is configured for drawing water axially inwardly through the section intake port 26 and for discharging the water outwardly through the tangentially oriented pressure discharge port 28. In accordance with one aspect of the invention, the pump chamber 24 is defined by a shell-shaped volute housing member 50 which in turn forms the intake and discharge ports 26, 28. This volute housing 50 has a size and shape for seated engagement with a peripheral rim 52 on the seal plate 16, with a circumferential band clamp 54 or the like being tightly secured about the peripheries of the volute housing 50 and the seal plate rim 52. As shown best in FIG. 2, the band clamp 54 may include a threaded stud 56 extending between circumferentially spaced-apart stops 58 and 60, with a rotary knob 62 threaded onto the stud 56 for drawing the stops 58, 60 toward each other for tightly retaining the components together. A seal ring 64 such as a large diameter elastomeric O-ring seal or the like is clamped between the periphery of the volute housing 50 and the seal plate rim 52 to prevent water leakage therebetween.

An inboard face of the volute housing 50 thus cooperates with an outboard face of the seal plate 16 to define the pump chamber 24 having the rotary driven impeller 14 therein. In a typical geometry as shown (FIG. 1), the volute housing 50 is oriented relative to the seal plate 16 with a generally tangential tubular segment 66 defining the discharge port 28 projecting vertically upwardly. In this orientation, a drain port 68 formed in the volute housing 50, and normally closed by a removable drain plug 70, is positioned generally at the bottom of the pump chamber 24. However, persons skilled in the art will recognize and appreciate that the clamp-mounted volute housing 50 can be assembled with the seal plate 16 in alternative orientations to accommodate specialized or atypical plumbing connection requirements.

In accordance with further important aspects of the invention, multiple seal components are carried by the seal plate 16, for substantially preventing leakage of water from an inboard side of the pump chamber 24, along the drive shaft 12, into potentially damaging contact with the shaft bearing 22 or the electric-powered drive motor 20. These multiple seal components include a primary seal assembly 72 (FIGS. 2–4) for sealing passage of the drive shaft 12 through the seal plate 16 and into the water environment of the pump chamber 24. A secondary seal assembly 74 (FIGS. 2 and 5) is additionally provided at a location axially between the shaft bearing 22 and the primary seal assembly 72, to provide a secondary safeguard against water migration in an inboard direction along the drive shaft 12 into contact with the shaft bearing 22.

Figure 4:
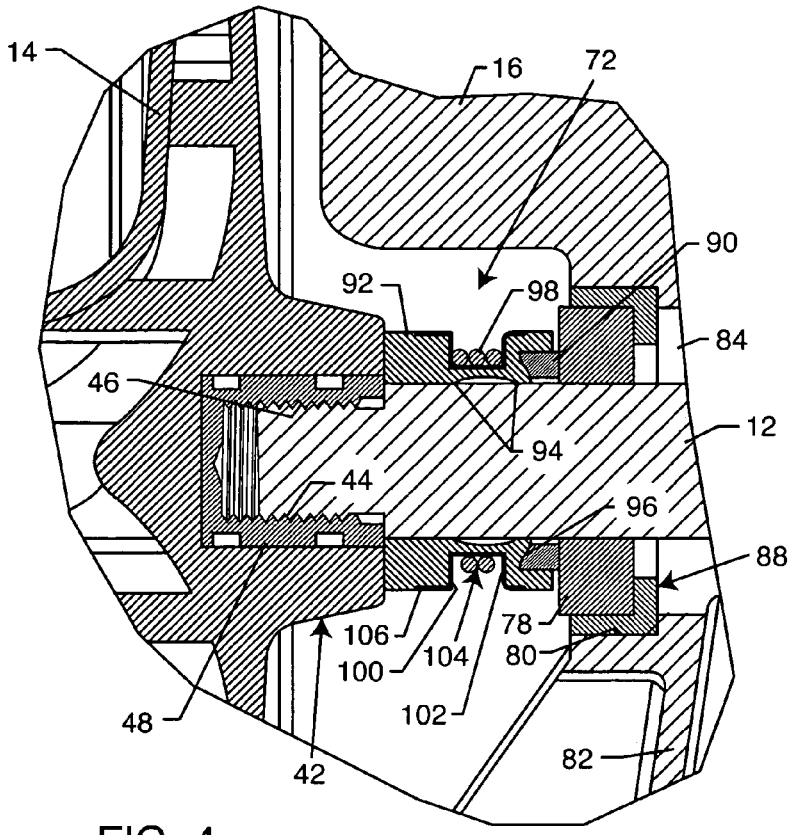
FIG. 4 is an enlarged fragmented sectional view corresponding generally with the encircled region 4 of FIG. 3.
Figure 5:
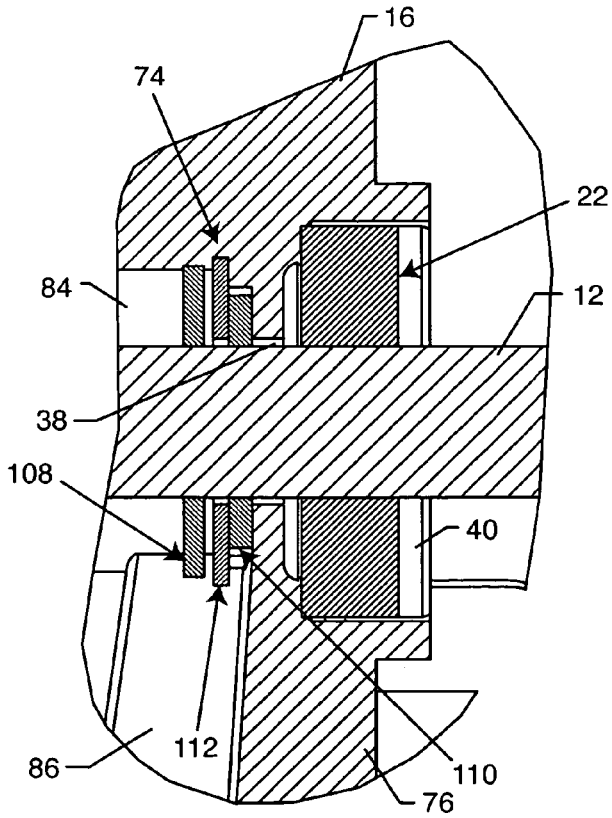
FIG. 5 is an enlarged fragmented sectional view corresponding generally with the encircled region 5 of FIG. 3.

More particularly, as viewed best in FIGS. 3–5, the shaft bearing 22 is seated within the counterbore 40 at an inboard side or face of an inner wall segment 76 of the seal plate 16. By contrast, the primary seal assembly 72 includes a stationary annular bushing 78 seated within a counterbore 80 formed in an outboard side or face of an outboard wall segment 82 of the seal plate 16. These inboard and outboard wall segments 76 and 82 of the seal plate 16 are axially separated by a vent chamber 84 having a lower end communicating with a drain channel 86 that is open to the atmosphere at a lower margin of the seal plate 16. The secondary seal assembly 74 is positioned within the vent chamber 84, at a location axially between the primary seal assembly 72 and the shaft bearing 22.

The stationary bushing 78 of the primary seal assembly 72 is shown in seated or nested relation within a cup-shaped annular support ring 88 which may be formed from a compliant rubber-based material or the like. This compliant support ring 88 thus sealingly supports the outer diameter of the bushing 78 relative to the outboard wall segment 82 of the seal plate 14, whereas the inner diameter of the bushing 78 is sized for at least slight running clearance relative to the rotary drive shaft 12. An annular outboard-presented face of the stationary bushing 78 is engaged by an axially spring-loaded dynamic seal ring 90 which is mounted onto the drive shaft 12 for rotation therewith. Accordingly, an axially inboard-presented annular face of the dynamic seal ring 90 is springably retained in running engagement with the stationary bushing 78, upon drive shaft rotation. In the preferred form, for relatively low friction running engagement between these components, the stationary bushing 78 is formed from a ceramic material, and the dynamic seal ring 90 is formed from a carbon-based or similar material.

The dynamic seal ring 90 is supported at an axially inboard end of a compliant annular base ring 92, formed from a rubber-based or other suitable elastomer and mounted onto the drive shaft 12 for rotation therewith. FIG. 4 shows this compliant base ring to include at least one and preferably multiple internal annular lands 94 which sealingly engage with the outer diameter of the drive shaft 12, and thus prevent water leakage between the inner diameter of the base ring 92 and the outer diameter of the drive shaft 12. The dynamic seal ring 90 is physically seated within an axially inboard-presented groove 96 at the rearmost or inboard end of the base ring. A mid-section of the compliant base ring 92 defines a radially outwardly open circumferential recessed groove 98 which separates an axially spaced-apart pair of shoulders 100 and 102. A biasing spring 104 is seated within this circumferential groove 98 to react against these shoulders 100, 102, for normally urging said shoulders 100, 102 axially apart, or axially away from each other. As shown in FIG. 4, the groove 98 and adjoining portions of the outer diameter of the base ring 92 can be surface-reinforced by a relatively thin layer 106 of metal or the like, such as a thin lining of stainless steel or the like.

The compliant base ring 92 is sufficiently expanded in an axial direction by the biasing spring 104 for applying a spring force to retain the dynamic seal ring 90 in spring-loaded running engagement with the stationary bushing 78. That is, as shown, the spring 104 retains an axial outboard end of the compliant base ring 92 in seated and substantially sealed engagement with an axial inboard-presented face on the central hub 42 of the impeller 14, and also retains the dynamic seal ring 90 in low friction running engagement with the stationary bushing 78. The running engagement between the dynamic seal ring 90 and the bushing 78 provides a high quality seal between these components to prevent water leakage therebetween. Conveniently, these components are each located at least partially within the pump chamber 24 where water circulating therethrough provides sufficient cooling of the sealing components to prevent friction-caused overheating.

In the event that the primary seal assembly 72, as described, permits any water leakage along the drive shaft 12 in an inboard direction toward the shaft bearing 22, the secondary seal assembly 74 intercepts such leaking water and physically re-directs it to the drain channel 86. More particularly, as shown best in FIG. 5 in accordance with one example of the invention, the secondary seal assembly 74 comprises at least one and preferably multiple slinger disks such as the illustrative axially spaced pair of slinger disks 108 and 110 carried on the drive shaft 12 for rotation therewith at a position within the vent chamber 84. An intermediate expansion washer 112 is desirably mounted onto the seal plate 16 between these two slinger disks 108 and 110, wherein this washer 112 is sized for relatively close running clearance relative to the drive shaft.

Accordingly, any water leaking in an inboard direction along the drive shaft 12 is initially re-directly radially outwardly by the first slinger disk 108. In the event that any residual water remains and continues to leak axially in an inboard direction along the drive shaft, such water must travel through a tortuous or labyrinthine path initially radially outwardly and then radially inwardly to pass through the narrow clearance at the inner diameter of the washer 112. In the unlikely event that continued leakage occurs, the second slinger disk 110 functions to again re-direct the leaking water in a radially outward direction for discharge through the drain channel 86. Persons skilled in the art will understand that alternative constructions for the secondary seal assembly 74 may be used, including but not limited to alternative seal arrangements including one or more slinger disks.

The improved motor-driven pump 10 of the present application thus provides a relatively short and compact overall pump length, attributable to combining multiple seal components including the primary and secondary seal assemblies 72 and 74 into the common seal plate 16 on the motor housing 18. With this construction, the primary seal assembly which seals passage of the drive shaft 12 into the pump chamber 24 is positioned relatively close to the shaft bearing 22, thereby reducing overall pump length while additionally providing a smooth-running and long-lived pump construction. Additional components such as mounting brackets of the type used in the prior art for spacing the pump chamber from the shaft bearing on the motor housing are thereby avoided.

A variety of further modifications and improvements in and to the improved motor-drive pump 10 of the present invention will be apparent to those persons skilled in the art. Accordingly, no limitation on the invention is intended by way of the foregoing description and accompanying drawings, except as set forth in the appended claims.

What is claimed is:

1. A motor-driven pump, comprising:

a motor mounted within a motor housing and adapted for rotatably driving a drive shaft;

a seal plate at one end of said motor housing, said seal plate having an outboard side and an inboard side relative to said motor housing, and said seal plate further defining a vent chamber formed between said outboard and inboard sides;

a shaft bearing within said motor housing and rotatably supporting said drive shaft extending through a ore formed in said seal plate;

a housing member defining a pump chamber having a suction intake port and a pressure discharge port;

an impeller carried by said drive shaft within said pump chamber for rotatable driving therein to pump fluid from said suction intake port to said pressure discharge port;

a primary seal assembly at said outboard side of said seal plate for preventing fluid leakage from said pump chamber along said drive shaft and into contact with said shaft bearing within said motor housing; and a secondary seal assembly disposed generally at said inboard side of said seal plate, and secondary seal assembly including an axially spaced pair of slinger disks carried by said drive shaft for rotation therewith within said vent chamber, and an expansion washer carried by said seal disk axially between said pair of slinger disks and in running clearance with said drive shaft, said pair of slinger disks and said expansion washer cooperatively defining a tortuous path for fluid leakage along said drive shaft, and said slinger disks slinging fluid leaking axially along said drive shaft in a radially outward direction.

2. The motor-driven pump of claim 1 wherein said seal plate cooperates with said housing member to define said pump chamber.

3. The motor-driven pump of claim 1 wherein said shaft bearing is carried at said inboard side of said seal plate.

4. The motor-driven pump of claim 1 wherein said primary seal assembly comprises a bushing carried by said seal plate in running clearance with said drive shaft, and a dynamic seal ring carried by said drive shaft for rotation therewith and in running engagement with said bushing.

5. The motor-driven pump of claim 4 wherein said dynamic seal ring is carried in axial running engagement with said bushing.

6. The motor-driven pump of claim 4 wherein said bushing is formed from a ceramic material, and wherein said dynamic seal real is formed from a carbon-based material.

7. The motor-driven pump of claim 4 further including a compliant base ring for supporting said dynamic seal ring for rotation with said drive shaft and in running engagement with said bushing.

8. The motor-driven pump of claim 7 further including a compliant support ring for supporting said bushing relative to said seal plate.

9. The motor-driven pump of claim 8 wherein said compliant support ring and said compliant base ring are formed from a rubber-based material.

10. The motor-driven pump of claim 4 further including spring means for urging said dynamic seal ring into running engagement with said bushing.

11. A motor-driven pump, comprising:

a motor mounted within a motor housing and adapted for rotatably driving a drive shaft;

a seal plate at one end of said motor housing, said seal plate having an outboard side and an inboard side relative to said motor housing, and said seal plate further defining a vent chamber formed between said outboard and inboard sides;

a shaft bearing within said motor housing and rotatably supporting said drive shaft extending through a ore formed in said seal plate;

a housing member defining a pump chamber having a suction intake port and a pressure discharge port;

an impeller carried by said drive shaft within said pump chamber for rotatable driving therein to pump fluid from said suction intake port to said pressure discharge port;

a primary seal assembly at said outboard side of said seal plate for preventing fluid leakage from said pump chamber along said drive shaft and into contact with said shaft bearing within said motor housing;

a secondary seal assembly disposed generally at said inboard side of said seal plate, and secondary seal assembly including at least one slinger disk rotatable within said vent chamber for slinging fluid leaking along said drive shaft in a radially outward direction;

spring means for urging said dynamic seal ring into running engagement with said bushing; and a base ring carried on said drive shaft for rotation therewith and disposed axially between said impeller and said bushing, said base ring being formed from a compliant material and defining a radially outwardly open recessed circumferential groove formed therein with axially opposed ends of said circumferential groove defining a pair of radially outwardly projecting stepped shoulders, said dynamic seal ring being carried at one axial end of said base ring for running engagement with said bushing, said spring means comprising a biasing spring seated with said circumferential groove and reacting axially against said shoulders for urging said one axial end of said base ring to position and retain said dynamic seal ring in running engagement with said bushing.

12. The motor-driven pump of claim 11 wherein said dynamic seal ring is seated within an axially open annular grove formed in said one axial end of said base ring.

13. A motor-driven pump, comprising:

a motor mounted within a motor housing and adapted for rotatably driving a drive shaft;

a seal plate at one end of said motor housing, said seal plate having an outboard side and an inboard side relative to said motor housing, and said seal plate further defining a vent chamber formed between said outboard and inboard sides;

a shaft bearing within said motor housing and rotatably supporting said drive shaft extending through a bore formed in said seal plate;

a housing member defining a pump chamber having a suction intake port and a pressure discharge port;

an impeller carried by said drive shaft within said pump chamber for rotatable driving therein to pump fluid from said suction intake port to said pressure discharge port;

a primary seal assembly at said outboard side of said seal plate for preventing fluid leakage from said pump chamber along said drive shaft and into contact with said shaft bearing within said motor housing, said primary seal assembly comprising a bushing, a dynamic seal ring, and a compliant base ring carried by said drive shaft for rotation therewith and for supporting said dynamic seal ring in axially running engagement with said bushing; and a secondary seal assembly at said inboard side of said seal plate, said secondary seal assembly including an axially spaced pair of slinger disks carried by said draft shaft for rotation therewith within said vent chamber, and an expansion washer carried by said seal disk axially between said pair of slinger disks and in running clearance with said drive shaft, said pair of slinger disks and said expansion washer cooperatively defining a tortuous path for fluid leakage along said drive shaft, and said slinger disks slinging fluid leaking axially along said drive shaft in a radially outward direction.

14. The motor-driven pump of claim 13 wherein said seal plate cooperates with said housing member to define said pump chamber.

15. The motor-driven pump of claim 13 wherein said shaft bearing is carried at said inboard of side of said seal plate.

16. The motor-driven pump of claim 13 further including spring means for urging said dynamic seal ring into running engagement with said bushing.

17. The motor-driven pump of claim 13 a compliant support ring for supporting said bushing relative to said seal plate.

18. A motor-driven pump comprising:

a motor mounted within a motor housing and adapted for rotatably driving a drive shaft;

a seal plate at one end of said motor housing, said seal plate having an outboard side and an inboard side relative to said motor housing, and said seal plate further defining a vent chamber formed between said outboard and inboard sides;

a shaft bearing within said motor housing and rotatably supporting said drive shaft extending through a bore formed in said seal plate;

a housing member defining a pump chamber having a suction intake port and a pressure discharge port;

an impeller carried by said drive shaft within said pump chamber for rotatable driving therein to pump fluid from said suction intake port to said pressure discharge port;

a primary seal assembly at said outboard side of said seal plate for preventing fluid leakage from said pump chamber along said drive shaft and into contact with said shaft bearing within said motor housing, said primary seal assembly comprising a bushing, a dynamic seal ring, and a compliant base ring carried by said drive shaft for rotation therewith and for supporting said dynamic seal ring in axially running engagement with said bushing;

a secondary seal assembly at said inboard side of said seal plate, said secondary seal assembly including at least one slinger disk rotatable within said vent chamber for slinging fluid leaking along said drive shaft in a radially outward direction;

spring means for urging said dynamic seal ring into running engagement with said bushing; and a radially outwardly open recessed circumferential groove formed in said base ring with axially opposed ends of said circumferential groove defining a pair of radially outwardly projecting stepped shoulders, said dynamic seal ring being carried at one axial end of said base ring for running engagement with said bushing, said spring means comprising a biasing spring seated within said circumferential groove and reacting axially against said shoulders for urging said one axial end of said base ring to position and retain said dynamic seal ring in running engagement with said bushing.

19. The motor-driven pump of claim 18 wherein said dynamic seal ring is seated within an axially open annular groove formed in said one axial end of said base ring.

20. The motor-driven pump of claim 18 further including a reinforcement lining within said circumferential groove of said base ring.

* * * * *